US009039115B2

(12) United States Patent
Zhang

(10) Patent No.: US 9,039,115 B2
(45) Date of Patent: May 26, 2015

(54) LIQUID EJECTING APPARATUS

(71) Applicant: Seiko Epson Corporation, Shinjuku-ku (JP)

(72) Inventor: Junhua Zhang, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/527,070

(22) Filed: Oct. 29, 2014

(65) Prior Publication Data

US 2015/0116402 A1 Apr. 30, 2015

(51) Int. Cl.
*B41J 29/38* (2006.01)
*B41J 2/045* (2006.01)

(52) U.S. Cl.
CPC ..... *B41J 2/04588* (2013.01)

(58) Field of Classification Search
CPC ..... B41J 2/04581; B41J 2/04588; B41J 2/04596; B41J 2/04541; B41J 2/0459; B41J 2/04591; B41J 2/04573
USPC ..... 347/9–11, 68
See application file for complete search history.

(56) References Cited

U.S. PATENT DOCUMENTS 6,840,595 B2 * 1/2005 Kusunoki ..... 347/10
7,794,034 B2 * 9/2010 Shingyohuchi et al. ..... 347/11
8,292,388 B2 * 10/2012 Matsushita et al. ..... 347/10

FOREIGN PATENT DOCUMENTS

JP 2011-073349 A 4/2011

* cited by examiner

*Primary Examiner* — An Do
(74) *Attorney, Agent, or Firm* — Kilpatrick Townsend & Stockton LLP

(57) ABSTRACT

A maintenance pulse is a pulsed waveform that includes an expansion element that causes a pressure chamber to expand, a contraction element that causes the pressure chamber that is expanded by the expansion element to contract, and a reexpansion element that causes the pressure chamber that is contracted by the contraction element to expand again, and satisfies the following condition (1) when a time from the beginning of the contraction element to the beginning of the reexpansion element is given the term T1, and a specific vibration period that is caused in the liquid inside the pressure chamber is given the term Tc.

$$1.2 \times Tc \leq T1 < 1.5 \times Tc \quad (1)$$

4 Claims, 8 Drawing Sheets

LIQUID EJECTING APPARATUS

This application claims priority to Japanese Patent Application No. 2013-225060, filed Oct. 30, 2013, the entirety of which is incorporated by reference herein.

BACKGROUND

1. Technical Field

The present invention relates to a liquid ejecting apparatus that ejects a liquid from nozzles.

2. Related Art

A liquid ejecting apparatus is an apparatus that is provided with a liquid ejecting head, and that ejects various kinds of liquid from the liquid ejecting head. For example, there are image recording apparatuses such as ink jet type printers and ink jet type plotters, but recently, liquid ejecting apparatuses are being applied in various production apparatuses by utilizing the feature that liquid ejecting apparatuses can reliably land an extremely small amount of a liquid on a predetermined position. For example, liquid ejecting apparatuses are applied in display production apparatuses that produce color filters such as liquid crystal displays, electrode formation apparatuses that form electrodes such as organic Electro Luminescence (EL) displays and Field Emission Displays (FED), and biochip production apparatuses that produce biochips (biotips). Further, in recording heads for image recording apparatuses, liquid ink is ejected, and solutions of the respective color materials of R (Red), G (Green) and B (Blue) are ejected by color material ejecting heads for display production apparatuses. In addition, in electrode material ejecting heads for electrode formation apparatuses, a liquid electrode material is ejected, and solutions of living organic matter are ejected by living organic matter ejecting heads for chip production apparatuses.

A liquid ejecting head such as that mentioned above is configured to introduce ink into pressure chambers from a cartridge in which ink (a type of liquid) is accommodated, bring about a pressure fluctuation in ink inside the pressure chambers, and eject ink from nozzles that lead to the pressure chambers. In addition, a maintenance process that is referred to as a flushing operation, which forcibly ejects ink from the nozzles is performed in a liquid ejecting apparatus that is provided with this kind of liquid ejecting head (for example, JP-A-2011-73349). This flushing operation is for example, performed after a cartridge is exchanged, after a predetermined amount of time has passed or the like, in order to expel air bubbles and ink that has thickened. More specifically, the liquid ejecting head is moved to a position that is shifted from a recording region, and ink is repeatedly ejected at this position.

Given that, since a surface of ink (the meniscus) that is exposed inside the nozzles of the liquid ejecting head is exposed to the atmosphere during the execution of a printing process on a recording medium, moisture in the ink gradually evaporates with the passage of time, and the viscosity of ink in the vicinity of the nozzles increases. When the viscosity of ink in the vicinity of the nozzles (in the periphery of the meniscus in particular) increases, there is a defect in that it is not possible to eject air bubbles and ink that has thickened from the nozzles in a stable manner in the flushing operation. This defect will be described using FIG. 8.

FIG. 8 is a peripheral cross-sectional view of a nozzle 97 that describes circumstances in which ink is ejected in a flushing operation. In addition, in FIG. 8, ink in the periphery of the meniscus, which is exposed to external air is thickened ink (ink with a high viscosity) Ih, and ink that is on a pressure chamber 98 side of the thickened ink Ih is normal ink (ink with a lower viscosity than the meniscus side) In. In the flushing operation, firstly, when the pressure chamber 98 is caused to rapidly contract after the meniscus is drawn into the pressure chamber 98 side by causing the pressure chamber 98 to expand, as shown in FIG. 8A, an ink droplet Id is ejected. Further, after the ejection of the ink droplet Id, as shown in FIG. 9, residual vibrations are generated. That is, after the ejection of the ink droplet Id, as shown in FIG. 8B, the meniscus moves to the pressure chamber 98 side again, and subsequently, as shown in FIG. 8C, the meniscus moves to an ejection side again. Additionally, in the coordinate axis of FIG. 9, the horizontal axis shows time t and the vertical axis shows positions of the meniscus so that a direction that leads toward the ejection side from the pressure chamber 98 side is positive. In addition, a time point that is shown as Pb is a time point at which the ink droplet Id is ejected. Furthermore, an interval between a time point Pa and a time point Pc is substantially equivalent to a specific period Tc (a specific vibration period Tc) of ink inside the pressure chamber 98, and a period of the subsequent residual vibrations is also substantially the same as the specific vibration period Tc.

In this instance, between the time point Pc and the time point Pd, that is, when the meniscus moves to the ejection side as shown in FIG. 8C, since the flowability of the thickened ink Ih that remains in the periphery of the meniscus is poor in comparison with ink In that moves from the pressure chamber 98 side, a portion of air gets trapped in the ink, and the trapped air gets left inside the ink as air bubbles B. The air bubbles B that enter the pressure chamber 98 side get into the pressure chamber 98 side due to a buoyant force or the like, and when the air bubbles B remain in a flow channel, the air bubbles B cause ink ejection defects.

SUMMARY

An advantage of some aspects of the invention is to provide a liquid ejecting apparatus that can even eject a liquid in a stable manner during maintenance in a case in which a liquid inside a nozzle has thickened.

A liquid ejecting apparatus of an aspect of the invention includes a liquid ejecting head that has a pressure chamber, which is in communication with a nozzle, and a pressure generation unit that brings about a pressure fluctuation in a liquid inside the pressure chamber, and is capable of ejecting the liquid from the nozzle through actuation of the pressure generation unit, and a driving signal generation unit that causes a maintenance driving signal, which includes a maintenance pulse that causes the liquid to be ejected from the nozzle, to be generated during maintenance. The maintenance pulse is a pulsed waveform that includes an expansion element that causes the pressure chamber to expand, a contraction element that causes a pressure chamber that is expanded by the expansion element to contract, and a reexpansion element that causes a pressure chamber that is contracted by the contraction element to expand again, and satisfies $$1.2\times Tc \leq T1 < 1.5\times Tc \quad (1)$$

when a time from the beginning of the contraction element to the beginning of the reexpansion element is given the term T1, and a specific vibration period that is caused in the liquid inside the pressure chamber is given the term Tc.

In this case, since the time T1 from the beginning of the contraction element to the beginning of the reexpansion element satisfies the condition (1), it is possible to expand the pressure chamber with the reexpansion element when the meniscus inside the nozzle that has been drawn into the pressure chamber side moves to the ejection side (a side that is opposite to the pressure chamber) again after the liquid has been ejected. As a result of this configuration, it is possible to reduce the severity of the movement of the meniscus that moves to the ejection side from the pressure chamber side. As a result of this, it is even possible to suppress a circumstance in which air bubbles become mixed in the liquid inside the nozzle when liquid in the periphery of the meniscus has thickened.

In the liquid ejecting apparatus, it is desirable that the maintenance pulse satisfy $$0.2\times Tc\leq T2<0.5\times Tc \quad (2)$$

when a time from the beginning of the reexpansion element to the end thereof is given the term T2.

In addition, In the liquid ejecting apparatus, it is desirable that the maintenance pulse satisfy $$0.1\times Vh\leq Vhm\leq 0.5\times Vh \quad (3)$$

when a change in voltage of the contraction element is given the term Vh, and a change in voltage of the reexpansion element is given the term Vhm.

In these cases, it is possible to sufficiently expand the pressure chamber with the reexpansion element, and therefore, it is possible to further reduce the severity of the movement of the meniscus that moves to the ejection side from the pressure chamber side in a reliable manner. As a result of this, it is possible to further reliably suppress a circumstance in which air bubbles become mixed in the liquid inside the nozzle.

In addition, in the liquid ejecting apparatus, it is desirable that a driving signal include a microvibration pulse that brings about a pressure fluctuation in the liquid inside the pressure chamber to an extent at which liquid is not ejected from the nozzle, and that the maintenance pulse be applied to the pressure generation unit after the microvibration pulse is applied to the pressure generation unit.

In this case, it is possible to stir the liquid that has thickened using the microvibration pulse in a case in which the liquid inside the nozzle has thickened. As a result of this configuration, it is possible to improve the flowability of the liquid in the periphery of the meniscus, and therefore, it is possible to suppress a circumstance in which air bubbles become mixed in the liquid inside the nozzle when liquid is subsequently ejected using the maintenance pulse.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for implementing the invention will be described with reference to the appended drawings. Additionally, in the embodiments that will be described below, various limitations are given as preferred specific examples of the invention, but the scope of the invention is not limited to these aspects unless a feature that limits the invention is specifically stated in the following description. In addition, in the following description, an ink jet type printer (hereinafter, referred to as a printer) that is equipped with an ink jet type recording head (hereinafter, referred to as a recording head), which is a kind of liquid ejecting head, is used as an example of a liquid ejecting apparatus of the invention.

Figure 1:
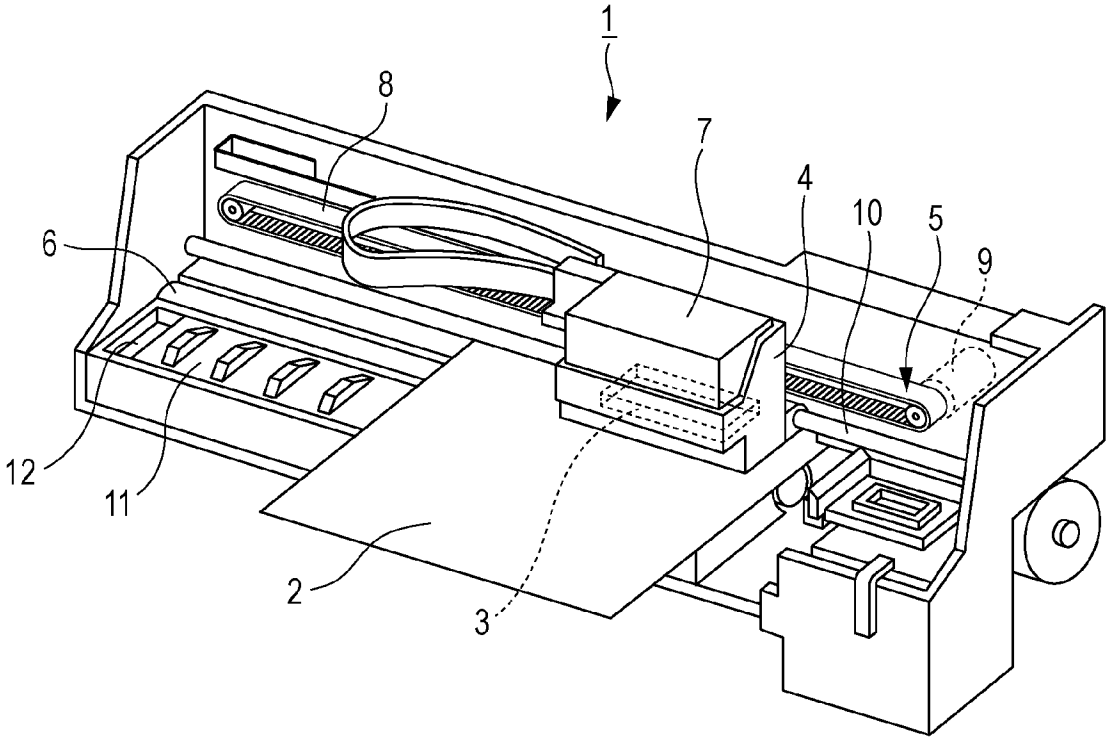
FIG. 1 is a perspective view that describes a configuration of a printer.

A configuration of a printer 1 will be described with reference to FIG. 1. The printer 1 is an apparatus that performs the recording of images or the like by ejecting liquid ink onto a surface of a recording medium 2 (a kind of landing target) such as recording paper. The printer 1 is provided with a recording head 3, a carriage 4 that is attached to the recording head 3, a carriage movement mechanism 5 that moves the carriage 4 in a main scanning direction, and a transport mechanism 6 that transports the recording medium 2 in a sub-scanning direction. In this instance, the ink that is mentioned above is a kind of liquid of the invention, and is accommodated in an ink cartridge 7 as a liquid supply source. The ink cartridge 7 is mounted to the recording head 3 (a holder 14 that will be mentioned later) in a removable manner. Additionally, it is also possible to adopt a configuration in which the ink cartridge 7 is disposed on an apparatus main body side of the printer 1, and in which ink is supplied from the ink cartridge 7 to the recording head 3 through an ink supply tube.

The carriage movement mechanism 5 that is mentioned above is provided with a timing belt 8. Further, the timing belt 8 is driven by a pulse motor 9 such as a DC motor. Therefore, when the pulse motor 9 is operated, the carriage 4 reciprocates in the main scanning direction (a width direction of the recording medium 2) guided by a guiding rod 10 that is provided in the printer 1 in a hanging manner.

A platen 11 is disposed below the recording head 3 during a recording operation. The platen 11 is positioned at an interval with respect to a nozzle formation surface (a nozzle plate: refer to FIG. 2) of the recording head 3 when the recording operation is performed, and supports the recording medium 2. In addition, a flushing box 12 is provided at an end portion of the main scanning direction of the platen 11, or in more detail, in a region that is shifted from a region (a recording region) in which ink is ejected onto the recording medium 2 that is disposed on the platen 11. The flushing box 12 is a member that collects ink that is ejected from the recording head 3 during a flushing operation, which is a kind of maintenance operation. The flushing box 12 of the present embodiment forms a box-shape that is open toward the top thereof (a recording head 3 side). Further, an ink absorber that is, for example, prepared using a urethane sponge or the like is arranged on a bottom surface inside of the flushing box 12. Additionally, it is desirable that the flushing box 12 be provided on both sides of the main scanning direction of the platen 11, but may be provided on at least one side.

Figure 2:
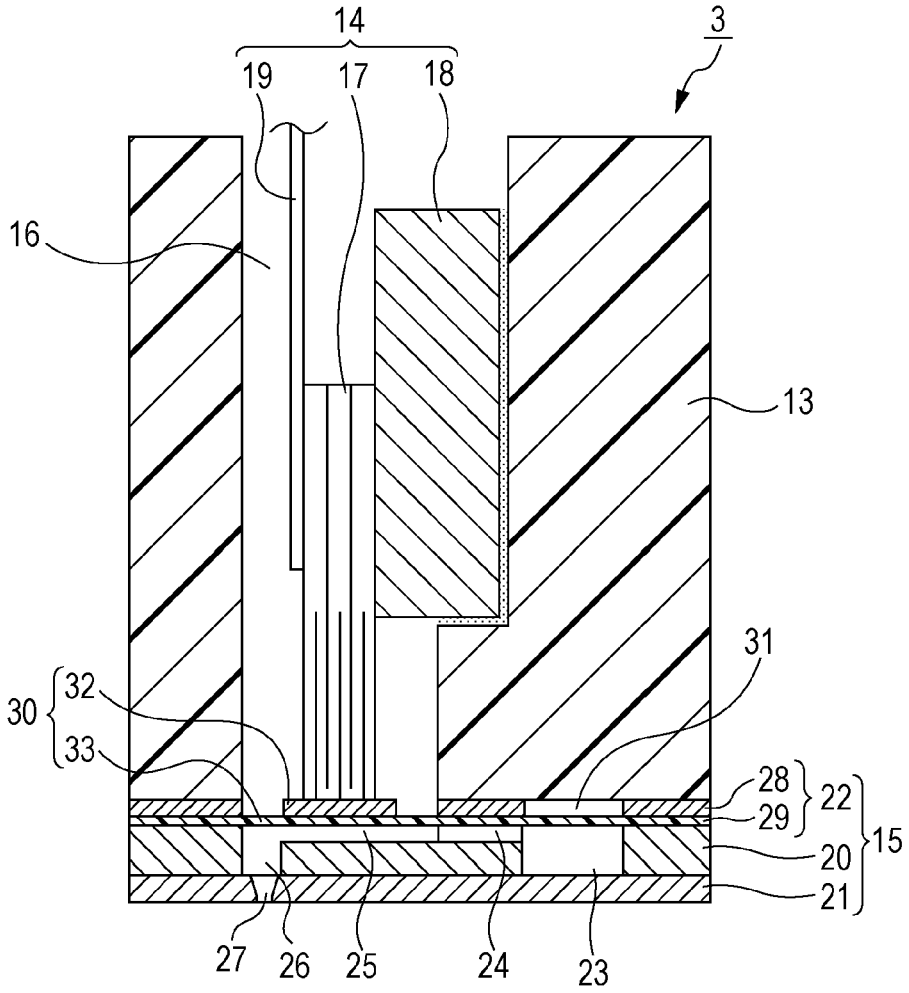
FIG. 2 is a cross-sectional view of a recording head.

FIG. 2 is a main section cross-sectional view that describes a configuration of the recording head 3. The recording head 3 is configured to be provided with a case 13, a vibration element unit 14 that is stored inside the case 13, and a flow channel unit 15 that is joined to a bottom surface (a lead end surface) of the case 13. The case 13 that is mentioned above is for example, prepared using an epoxy-based resin, and a storage space 16 for storing the vibration element unit 14 is formed inside the case 13. The vibration element unit 14 is provided with a piezoelectric element 17 that functions as a kind of pressure generation unit, a fixing plate 18 to which the piezoelectric element 17 is joined, and a flexible cable 19 for supplying a driving signal to the piezoelectric element 17. The piezoelectric element 17 is a laminate type piezoelectric element that is prepared by cutting a piezoelectric plate in which a piezoelectric body layer and an electrode layer are alternately laminated into a pectinate shape, and is a longitudinal vibration mode piezoelectric element that is capable of expanding and contracting in a direction that is orthogonal to the lamination direction.

The flow channel unit 15 is configured by respectively joining a nozzle plate 21 to one surface of a flow channel formation base plate 20, and an elastic plate 22 to the other surface of the flow channel formation base plate 20. A reservoir 23, an ink supply opening 24, a pressure chamber 25, a nozzle communication opening 26 and a nozzle 27 are formed in the flow channel unit 15. Further, a sequence of ink flow channels that reach the nozzle 27 from the ink supply opening 24 via the pressure chamber 25 and the nozzle communication opening 26 is formed for each nozzle 27.

The nozzle plate 21 that is mentioned above is a thin plate that is formed from a stainless steel (SUS), a silicon monocrystal or the like, and a plurality of rows (nozzle rows) of the nozzles 27 are provided therein. The elastic plate 22 that is mentioned above is a double structure in which an elastic body film 29 that is formed from a resin film or the like is laminated on the surface of a support plate 28 that is formed from a metal or the like. A diaphragm portion 30 that causes a change in the capacity of the pressure chamber 25 is provided in the elastic plate 22. The diaphragm portion 30 is formed from an island portion 32 to which a lead end surface of the piezoelectric element 17 is joined, and a thin-walled elastic portion 33 that surrounds the island portion 32. In addition, a compliance portion 31 that seals a portion of the reservoir 23 is provided in the elastic plate 22. The compliance portion 31 functions as a damper that absorbs the pressure fluctuations of ink that is accommodated in the reservoir 23.

Further, since the lead end surface of the piezoelectric element 17 is joined to the island portion 32 that is mentioned above, it is possible to vary the capacity of the pressure chamber 25 by expanding and contracting the free end portion of the piezoelectric element 17. Pressure fluctuations are generated in the ink inside the pressure chamber 25 according to these fluctuations in capacity. Further, the recording head 3 discharges ink droplets from the nozzles 27 using the pressure fluctuations.

Figure 3:
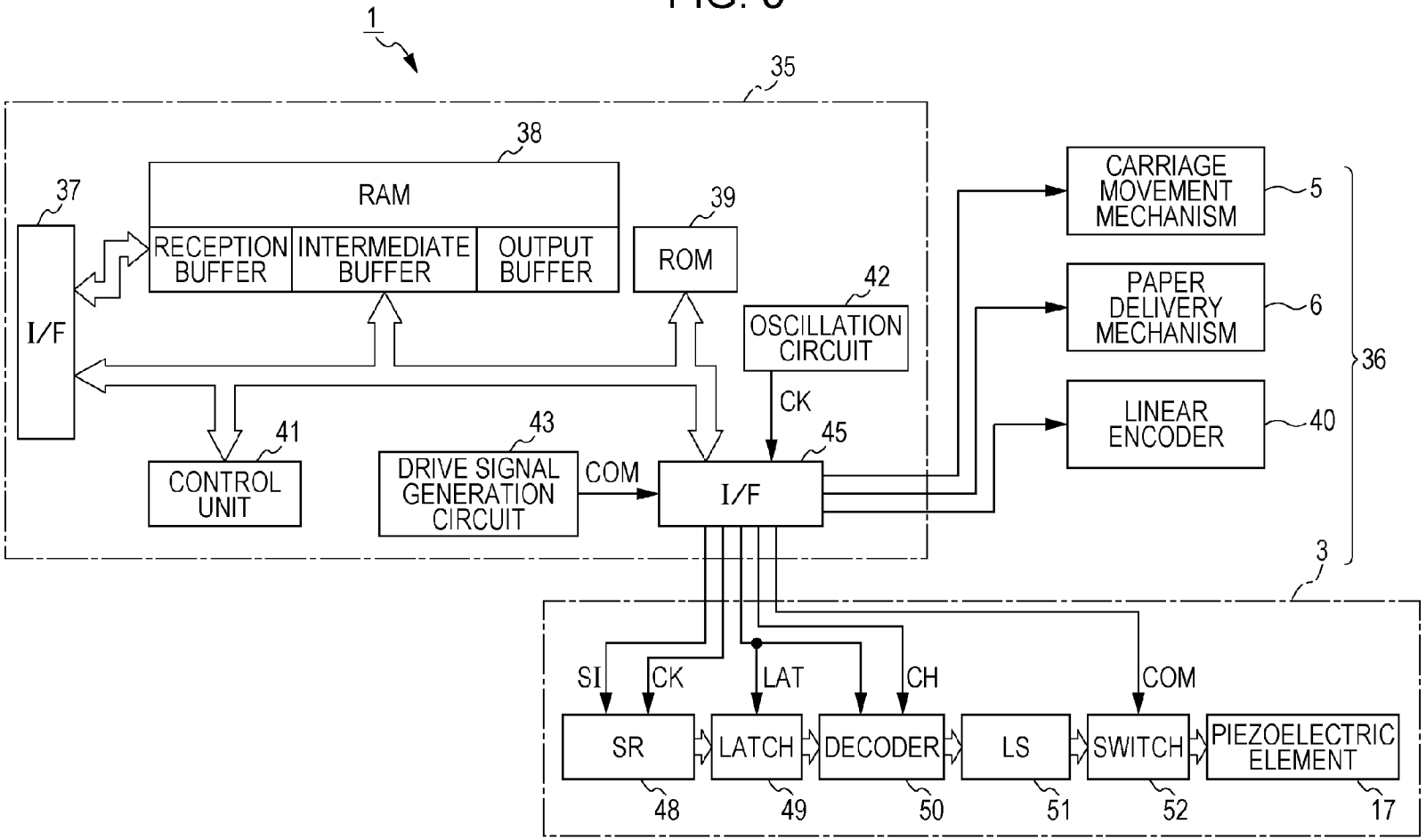
FIG. 3 is a block diagram that describes an electrical configuration of the printer.

FIG. 3 is a block diagram that shows an electrical configuration of the printer 1. The printer 1 is roughly configured by a printer controller 35 and a print engine 36. The printer controller 35 is provided with an external interface (an external I/F) 37 into which printing data or the like is input from an external apparatus such as a host computer, RAM 38 that stores various data and the like, ROM 39 in which control routines and the like for various processes are stored, a control unit 41 that performs control of the various units, an oscillation circuit 42 that generates a clocking signal, a driving signal generation circuit 43 (a kind of a driving signal generation unit in the invention) that generates a driving signal that is supplied to the recording head 3, and an internal interface (an internal I/F) 45 for outputting image data and driving signals that are obtained by developing print data for each dot to the recording head 3.

The control unit 41 outputs a head control signal for controlling the operation of the recording head 3 to the recording head 3, outputs a control signal for creating the driving signal COM to the driving signal generation circuit 43 an the like. In addition, the control unit 41 performs halftone processing, dot pattern development processing and the like on the basis of the abovementioned print data, and creates pixel data SI that is used in discharge control of the recording head 3. The pixel data SI is data that is related to the pixels of an image to be printed, and is a kind of discharge control information. In this instance, a pixel represents a dot formation region that is established virtually on a recording medium such as recording paper, which is a landing target.

The driving signal generation circuit 43 is controlled by the control unit 41 and generates a driving signal COM and various driving signals. The driving signal COM is an analog voltage signal that is input to the piezoelectric element 17 of the recording head 3 during a recording operation or a flushing operation, and is a series of signals that includes a plurality of pulsed waveforms in a unit recording period (a liquid ejection period). Additionally, the flushing operation refers to an operation that forcibly ejects ink from the nozzles 27 in order to expel air bubbles and ink that has thickened. A driving signal COM (a maintenance driving signal) during this flushing operation will be described later in more detail.

Next, the configuration of the print engine 36 side will be described. The print engine 36 is configured from the recording head 3, the carriage movement mechanism 5, the transport mechanism 6, and a linear encoder 40. The recording head 3 is provided with a shift register (SR) 48, a latch 49, a decoder 50, a level shifter (LS) 51, a switch 52 and the piezoelectric element 17 to correspond to each nozzle 27. The pixel data SI from the printer controller 35 is serially transmitted to the shift register 48 in synchronization with a clocking signal CK from the oscillation circuit 42.

The latch 49 is electrically connected to the shift register 48, and when a latch signal LAT is input into the latch 49 from the printer controller 35, image data of the shift register 48 is latched. The image data that is latched by the latch 49 is input into the decoder 50. The decoder 50 creates pulse selection data by translating 2-bit image data. In addition, the decoder 50 outputs pulse selection data to the level shifter 51 each time a latch signal LAT or a channel signal CH is received. In this case, the pulse selection data is input into the level shifter 51 in order from the highest bit. The level shifter 51 functions as a voltage amplifier, and outputs an electric signal that has been raised to a voltage that can drive the switch 52. The pulse selection data that is raised by the level shifter 51 is supplied to the switch 52. The driving signal COM from the driving signal generation circuit 43 is supplied to an input side of the switch 52, and the piezoelectric element 17 is connected to an output side of the switch 52. Further, the pulse selection data controls the operation of the switch 52, that is, the supply of a discharge pulse in the driving signal to the piezoelectric element 17.

Figure 4:
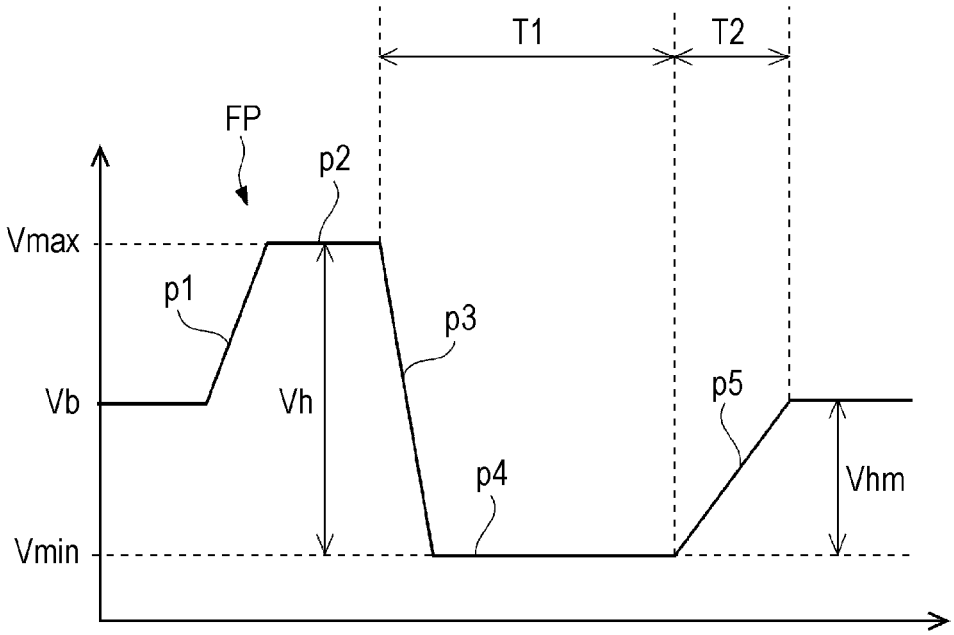
FIG. 4 is a waveform chart that describes a configuration of a maintenance pulse.

Next, a driving signal COM (a maintenance driving signal) during the flushing operation will be described. FIG. 4 is a waveform chart that shows an example of a configuration of a maintenance pulse FP that is included in the maintenance driving signal. Further, in addition to the maintenance pulse FP, other pulses (for example, a microvibration pulse and the like) that cause the meniscus to vibrate are included in the maintenance driving signal. This point will be described later. In addition, in FIG. 4, the vertical axis represents potential, and the horizontal axis represents time. Furthermore, as shown in FIG. 4, if the maintenance pulse FP of the present embodiment is averaged, it has a positive polarity. The maintenance pulse FP includes an expansion element p1 that causes the pressure chamber 25 to expand from a standard capacity (a capacity that is a point of origin for expansion and contraction) as a result of a potential changing to a positive side from a standard potential Vb (an intermediate potential) to a maximum potential (a maximum voltage) Vmax, an expansion retention element p2 that retains the maximum potential Vmax for a set period of time, a contraction element p3 that causes an expanded pressure chamber 25 to contract rapidly as a result of the potential changing to a negative side from the maximum potential Vmax to a minimum potential (a minimum voltage) Vmin, a contraction retention element p4 that retains the minimum potential Vmin for a set period of time and a reexpansion element p5 that causes a contracted pressure chamber to expand again to the standard capacity as a result of the potential changing to a positive side from the minimum potential Vmin to the standard potential Vb.

In this case, the maintenance pulse FP is set so as to satisfy the following condition (1) when a time from the beginning of the contraction element p3 to the beginning of the reexpansion element p5 is given the term T1, and a specific vibration period (the Helmholtz period) that is caused in the ink inside the pressure chamber is given the term Tc.

$$1.2\times Tc\leq T1<1.5\times Tc \quad (1)$$

In addition, the maintenance pulse FP of the present embodiment is set so as to satisfy the following condition (2) when a time from the beginning of the reexpansion element p5 to the end thereof is given the term T2.

$$0.2\times Tc\leq T2<0.5\times Tc \quad (2)$$

Furthermore, the maintenance pulse FP of the present embodiment is set so as to satisfy the following condition (3) when a change in voltage of the contraction element p3 is given the term Vh, and a change in voltage of the reexpansion element p5 is given the term Vhm.

$$0.1\times Vh\leq Vhm\leq 0.5\times Vh \quad (3)$$

In addition, the maintenance pulse FP is set so that a time from the beginning of the expansion element p1 to the end of the expansion retention element p2 is Tc/2. In addition, the maintenance pulse FP is set so that a time from the beginning of the contraction element p3 to the end thereof is Tc/3.

Additionally, the specific vibration period Tc is established specifically depending on the shapes, dimensions, rigidities and the like of each constituent member such as the nozzle 27, the pressure chamber 25, the ink supply opening 24 and the piezoelectric element 17. The specific vibration period Tc can, for example, be expressed by the following formula (4).

$$Tc=2\pi\sqrt{[\{(Mn\times Ms)/(Mn+Ms)\}\times Cc]} \quad (4)$$

In formula (4), Mn is inertance in the nozzles 27, Ms is inertance in the ink supply opening 24 and Cc is compliance of the pressure chamber 25 (shows a change in capacity and a degree of softness per unit pressure). In addition, in the abovementioned formula (4), the inertance M shows the ease of movement of a liquid in the flow channels such as the nozzles 27, or in other words, the mass of a liquid per unit cross-sectional area. Further, the inertance M can be expressed by approximating with the following formula (5) when the density of a fluid is given the term ρ, a cross-sectional area of a surface that is orthogonal to a downward flow direction of the fluid in the flow channels is given the term S, and a length of the flow channels is given the term L.

$$M=(\rho\times L)/S \quad (5)$$

Additionally, Tc is not limited to a period that is stipulated by the abovementioned formula (4), and may be a vibration period that the pressure chamber 25 of the recording head 3 has.

A maintenance driving signal that is included in a maintenance pulse FP that is configured in the abovementioned manner is supplied to the piezoelectric element 17 during the flushing operation. In this case, the flushing operation is performed after performing initial filling when the ink cartridge 7 is exchanged, each time a predetermined period of time passes in a recording operation (alternately, each time a predetermined number of passes (scans of the recording head 3) is performed, or each time a predetermined number of pages is printed) or the like. The flushing operation of the present embodiment is performed in a state in which the recording head 3 is moved above the flushing box 12 as a result of driving the carriage movement mechanism 5. In this kind of flushing operation, there was a defect in that the ejection of ink could not be performed in a stable manner due to air bubbles being mixed in in the maintenance driving signal of the related art in cases in which the ink in the periphery of the meniscus had thickened. That is, when air bubbles are mixed in, there are defects such as the ejection of ink being blocked by the air bubbles and the expulsion of thickened ink being difficult. Therefore, in the related art a greater amount of ink was consumed in order to expel thickened ink. In contrast to this, by using a maintenance driving signal that includes the maintenance pulse FP of the invention, it becomes possible to perform the ejection of ink in a stable manner by suppressing the mixing in of air bubbles even when the ink in the periphery of the meniscus has thickened. This point will be described later.

Figure 5:
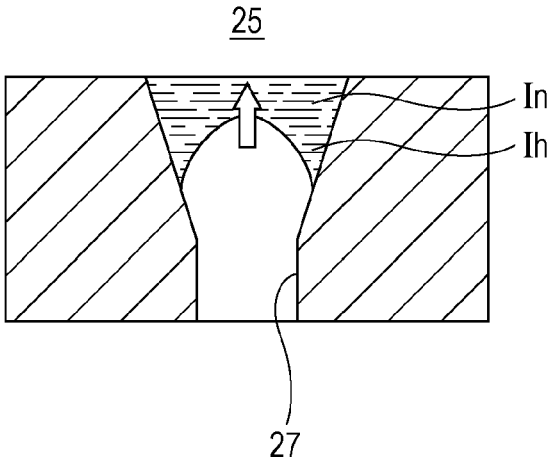
FIG. 5 is a cross-sectional view of the periphery of a nozzle that describes a circumstance in which ink is ejected in a flushing operation.

FIG. 5 and FIGS. 6A, 6B and 6C are cross-sectional views of the periphery of a nozzle 27 that describe circumstances in which ink is ejected in a flushing operation. In FIG. 5 and FIGS. 6A, 6B and 6C, ink in the periphery of the meniscus is thickened ink (ink with a high viscosity) Ih, and ink that is on a pressure chamber side of the thickened ink Ih is normal ink (ink with a low viscosity) In. When the maintenance pulse FP that is mentioned above is supplied to the piezoelectric element 17, firstly, the piezoelectric element 17 contracts in a longitudinal direction due to the expansion element p1, and as a result of this, the pressure chamber 25 expands from the standard capacity that corresponds to the standard potential Vb to an expanded capacity that corresponds to the maximum potential Vmax. As a result of this expansion, as shown in FIG. 5, the meniscus (thickened ink Ih in the periphery of the meniscus) is drawn into a pressure chamber 25 side (an upper side in FIG. 5), and ink is supplied to the inside of the pressure chamber 25 from the reservoir 23 side via the ink supply opening 24. Further, an expanded state of the pressure chamber 25 is retained (held) by the expansion retention element p2.

Figure 6A:
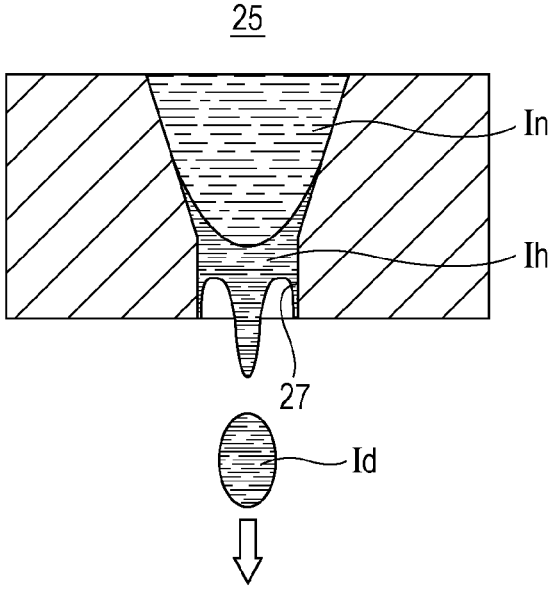
FIGS. 6A, 6B and 6C are cross-sectional views of the periphery of a nozzle that describe circumstances in which ink is ejected in a flushing operation.
Figure 9:
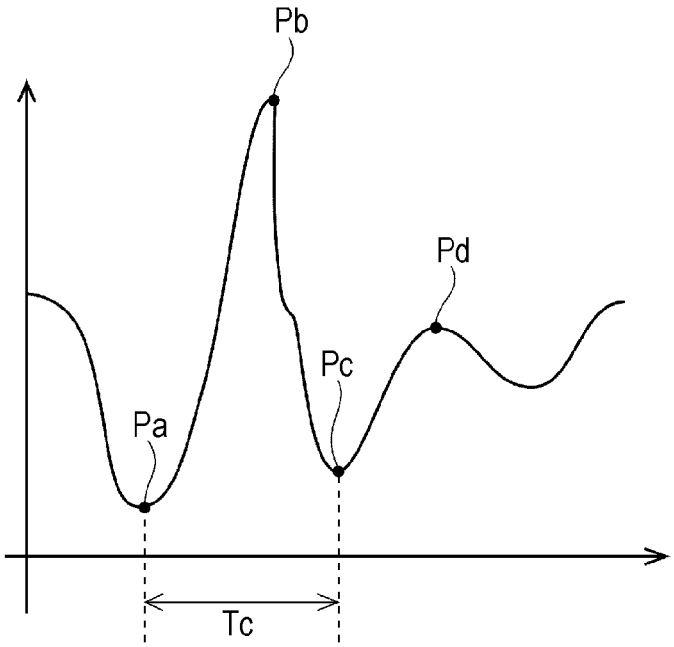
FIG. 9 is a schematic diagram that describes the movement of a meniscus inside a nozzle during ink ejection.

After the holding due to the expansion retention element p2, the contraction element p3 is supplied and the piezoelectric element 17 extends rapidly. As a result of this, the pressure chamber 25 contracts rapidly from the expanded capacity to a contracted capacity that corresponds to the minimum potential Vmin. As a result of this, the ink inside the pressure chamber 25 is pressurized, and in addition to the meniscus moving to a side that is opposite the pressure chamber 25 (a lower side in FIGS. 6A, 6B and 6C (an ejection side)), a central portion of the meniscus is extruded to a lower side. This extruded portion extends in a liquid column (an ink column), and a lead end portion thereof is separated in the midst thereof. As shown in FIG. 6A, this separated portion is ejected from the nozzle 27 as an ink droplet Id and flies. Additionally, vibrations of the meniscus also remain after the ejection of the ink droplet Id as residual vibrations of the specific vibration period Tc. That is, as shown in FIG. 9, the meniscus vibrates up and down in the period Tc from a time point Pa when the inside of the pressure chamber 25 starts to contract. Additionally, the time point Pa in FIG. 9 is substantially equivalent to the beginning of the contraction element p3. In addition, a period of time from the time point Pa to a time point Pc is substantially equivalent to the specific vibration period Tc and a period of time from the time point Pc to a time point Pd is substantially equivalent to half the specific vibration period Tc.

Figure 6B:
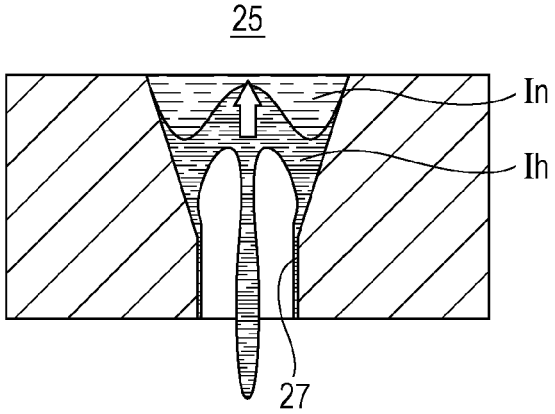

Subsequently, the contracted capacity is retained by the contraction retention element p4 for an amount of time that is equivalent to a time taken from the beginning of the contraction element p3 to T1. At this time, as shown in FIG. 6B, the meniscus moves to an upper side (the pressure chamber 25 side) while keeping the ink column. Further, when an amount of time that is substantially equivalent to Tc has passed from time point Pa (the beginning of the contraction element p3) at which the inside of the pressure chamber 25 starts to contract, the meniscus is displaced to a maximum position (a position after the ejection of the ink droplet Id at which the meniscus is drawn into the pressure chamber 25 side most) on the upper side (the time point Pc in FIG. 9). Subsequently, the meniscus starts to move from the maximum position on the upper side toward a lower side (a side that is opposite to the pressure chamber 25) again. Next, when the reexpansion element p5 is supplied, the piezoelectric element 17 contracts in the longitudinal direction, and as a result of this, the pressure chamber 25 expands again from the contracted capacity to a standard capacity that corresponds to the standard potential Vb.

Figure 6C:
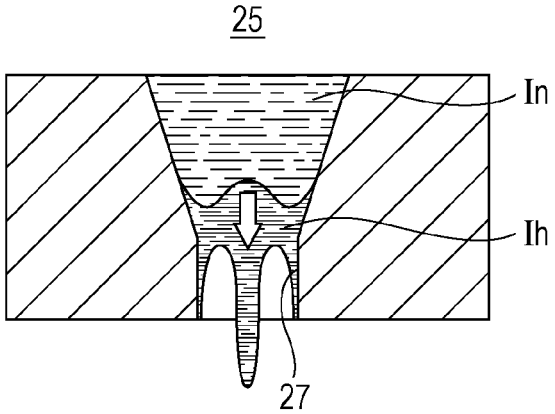

In this case, since the time T1 from the beginning of the contraction element p3 to the beginning of the reexpansion element p5 satisfies the abovementioned condition (1), it is possible to expand the pressure chamber 25 with the reexpansion element p5 when the meniscus inside the nozzle 27 that has been drawn into the maximum position on the upper side moves to the lower side again (a period from the time point Pc to the time point Pd in FIG. 9) after ink has been ejected. As a result of this reexpansion of the pressure chamber 25 due to the reexpansion element p5, it is possible to pull the meniscus, which is moving toward the lower side from the maximum position on the upper side, to the upper side, and therefore, it is possible to suppress the amplitude of residual vibrations. As a result of this, the severity of the movement of the meniscus is reduced, and therefore, it is possible to suppress a circumstance in which the ink in the periphery of the meniscus moves in a complicated manner such as flowing in a whirl. As a result, as shown in FIG. 6C, it is even possible to suppress a circumstance in which air bubbles become mixed in the ink inside the nozzle 27 when ink in the periphery of the meniscus has thickened. Additionally, it is desirable that the beginning of the reexpansion element p5 be shifted from the time point Pc in which amplitude is particularly large by a period of 0.2×Tc so that, in a case in which the phase of residual vibrations is shifted, the residual vibrations do not become stronger. That is, by shifting the beginning of the reexpansion element p5 from a maximum point or a minimum point, it is possible to suppress a circumstance in which the residual vibrations become stronger, and therefore, it is possible to further reduce the severity of the movement of the meniscus in a reliable manner.

In addition, in the present embodiment, since the time T2 from the beginning of the reexpansion element p5 to the end thereof satisfies the abovementioned condition (2) and (3), it is possible to sufficiently expand the pressure chamber 25 with the reexpansion element p5, and therefore, it is possible to further reduce the severity of the movement of the meniscus, which moves from the pressure chamber 25 side to the lower side, in a reliable manner. That is, as a result of the abovementioned conditions (2) and (3), it is possible to reduce the severity of the movement of the meniscus to the lower side to a degree at which air bubbles do not become mixed in. As a result, it is possible to further reliably suppress a circumstance in which air bubbles become mixed in the ink inside the nozzle 27. In other words, by satisfying the abovementioned conditions (2) and (3), it is possible to prevent a circumstance in which the drawing in of the meniscus being insufficient and air bubbles becoming mixed in as a result of not being able to reduce the severity of the movement of the meniscus, or conversely, circumstances in which the air bubbles are mixed in and as a result of the meniscus being drawn in excessively and erroneous ink ejection (satellites) occurs as a result of the meniscus being drawn in excessively.

Incidentally, the maintenance driving signal of the present embodiment includes a microvibration pulse that brings about a pressure fluctuation in the ink inside the pressure chamber 25 to an extent at which ink is not ejected from the nozzle 27. The microvibration pulse uses, for example, a so-called trapezoid waveform that is formed from an expansion element that causes the pressure chamber 25 to expand from a standard capacity as a result of a potential changing to a positive side from a standard potential (an intermediate potential), an expansion retention element that retains the potential for a set period of time, and a contraction element that causes an expanded pressure chamber 25 to contract as a result of the potential changing to the standard potential. Further, when the microvibration pulse is input into the piezoelectric element 17, the pressure chamber 25 microvibrates, and ink inside the nozzle 27 is stirred. In the present embodiment, the maintenance pulse FP is configured so as to be applied to the piezoelectric element 17 after the microvibration pulse is applied to the piezoelectric element 17. As a result of this, it is possible to stir the ink that has thickened using the microvibration pulse in a case in which the ink inside the nozzle 27 has thickened. As a result, it is possible to improve the flowability of the ink in the periphery of the meniscus, and therefore, it is possible to further suppress a circumstance in which air bubbles become mixed in the liquid inside the nozzle 27 when ink is subsequently ejected using the maintenance pulse FP.

Figure 7:
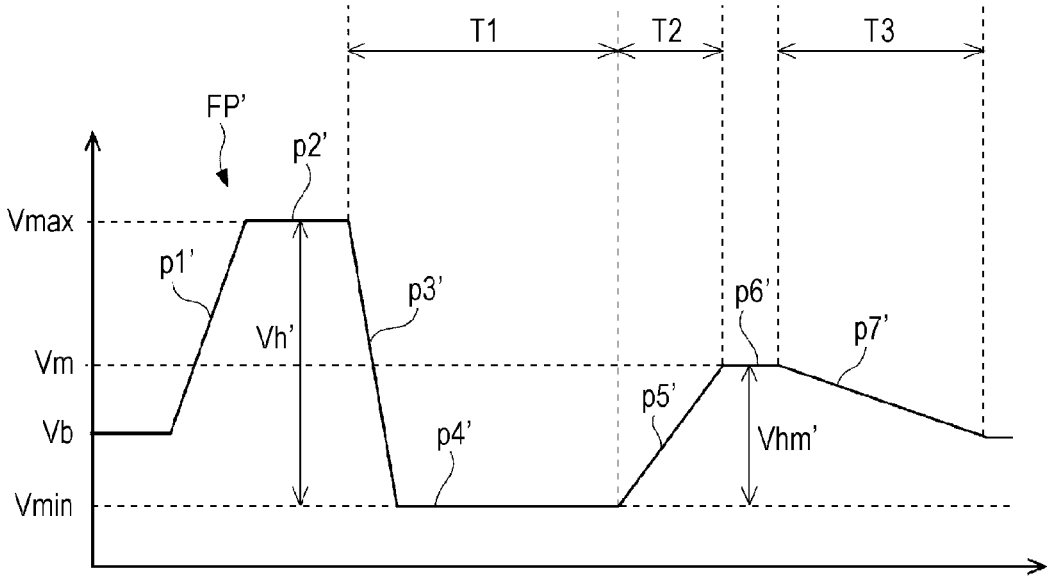
FIG. 7 is a waveform chart that describes a configuration of a maintenance pulse in a second embodiment.
Figure 8A:
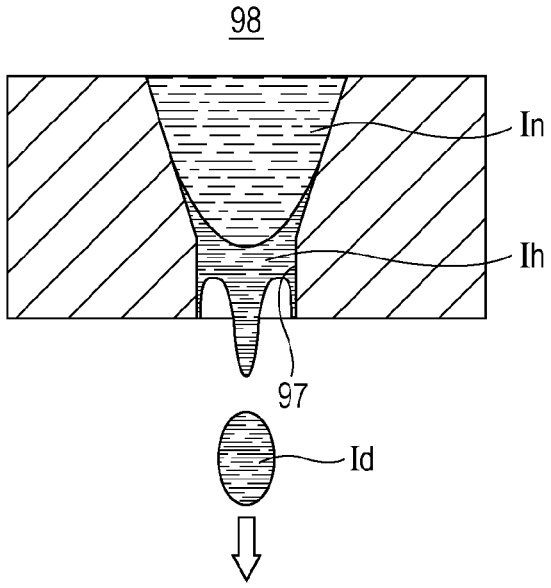
FIGS. 8A, 8B and 8*c* are cross-sectional views of the periphery of a nozzle that describe circumstances in which ink is ejected in a configuration of the related art.
Figure 8B:
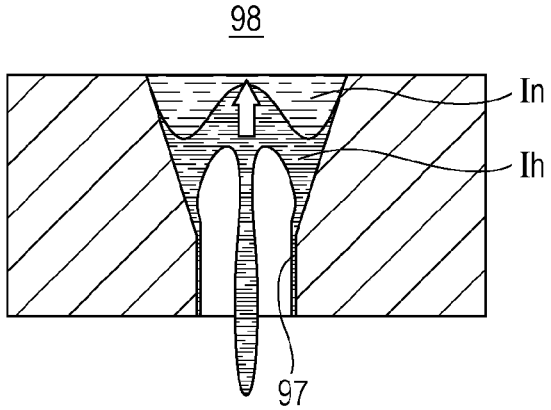
Figure 8C:
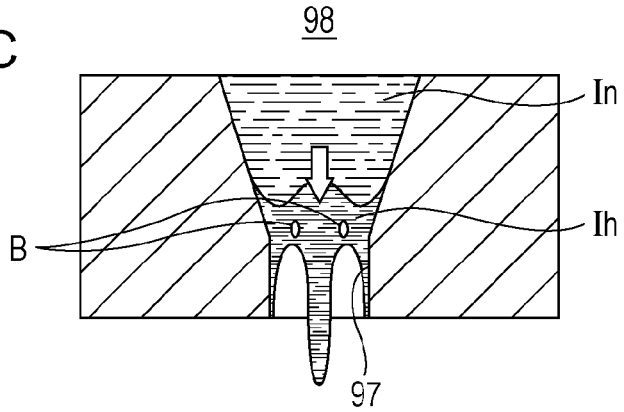

Incidentally, the maintenance pulse is not limited to the embodiment that is mentioned above. For example, a maintenance pulse FP' of a second embodiment that is shown in FIG. 7 includes a reexpansion retention element p6' and a reexpansion element p7' after a reexpansion element p5'. In addition, in the maintenance pulse FP' of the second embodiment, the standard potential Vb is set to be lower than a potential that is intermediate between the maximum potential Vmax and the minimum potential Vmin.

If described in detail, the maintenance pulse FP' of the second embodiment includes an expansion element p1' that causes the pressure chamber 25 to expand from a standard capacity as a result of a potential changing to a positive side from a standard potential Vb to a maximum potential Vmax, an expansion retention element p2' that retains the maximum potential Vmax for a set period of time, a contraction element p3' that causes an expanded pressure chamber 25 to contract rapidly as a result of the potential changing to a negative side from the maximum potential Vmax to a minimum potential Vmin, a contraction retention element p4' that retains the minimum potential Vmin for a set period of time, a reexpansion element p5' that causes a contracted pressure chamber to expand again as a result of the potential changing to a positive side from the minimum potential Vmin to a potential Vm that is higher than the standard potential Vb, the reexpansion retention element p6' that retains the potential Vm for a set period of time, and the reexpansion element p7' that causes an expanded pressure chamber to contract steadily to the standard capacity as a result of the potential changing to a negative side from the potential Vm to the standard potential Vb. Additionally, since the configuration from the beginning of the expansion element p1' to the beginning of the reexpansion element p5' is the same as the configuration from the beginning of the expansion element p1 to the beginning of the reexpansion element p5 of the maintenance pulse FP in the first embodiment that is mentioned above, description thereof has been omitted.

In this case, there is a concern that the vibration inhibitory effect of the residual vibrations will not be sufficiently obtained in a maintenance pulse in which the standard potential Vb is set to be low in the manner of the present embodiment. Therefore, in the maintenance pulse FP' of the present embodiment, a tail end potential of the reexpansion element p5' is configured to change to a positive side that exceeds the standard potential Vb. Further, in the same manner as the condition (3) of the first embodiment, the maintenance pulse FP' of the present embodiment is also set so as to satisfy the following condition (6) when a change in voltage of the contraction element p3' is given the term Vh', and a change in voltage of the reexpansion element p5' is given the term Vhm'.

$$0.1\times Vh' \leq Vhm' \leq 0.5\times Vh' \quad (6)$$

As a result of this, it is also possible to improve the vibration inhibitory effect in cases in which the standard potential Vb is reduced. As a result, it is possible to further suppress a circumstance in which air bubbles become mixed in the ink inside the nozzle 27. Additionally, the time T2 from the beginning of the reexpansion element p5' to the end thereof of the embodiment is set to satisfy the abovementioned condition (2).

Further, after the reexpansion element p5', the potential Vm which is higher than the standard potential Vb is retained by the reexpansion retention element p6' for a set amount of time, and gradually returns to the standard potential Vb due to the reexpansion element p7'. In this case, a time T3 from the beginning of the reexpansion element p7' to the end thereof is set to be greater than or equal to Tc. As a result of this configuration, it is possible to return the pressure chamber 25 that has expanded to a capacity that corresponds to the potential Vm to the standard capacity gradually. As a result, it is possible to suppress disturbance of the meniscus due to the meniscus being rapidly pushed to the ejection side, and therefore, it is possible to suppress a circumstance in which air bubbles become mixed in the ink inside the nozzle 27.

Incidentally, the invention is not limited to the embodiments mentioned above, and various alterations are possible on the basis of the claims. For example, in the embodiments mentioned above, a so-called longitudinal vibration type piezoelectric element 17 is used as an example of a pressure generation unit, but the invention is not limited to this configuration and for example, can adopt a so-called deflection vibration type piezoelectric element. In this case, in the driving signal that is shown as an example, the direction of a change in potential, that is, the ups and downs are reversed.

Further, in the embodiments mentioned above, an ink jet recording head that an ink jet printer is equipped with is used as an example, but it is also possible to apply the present invention to liquid ejecting heads that eject liquids other than ink. For example, it is also possible to apply the present invention to color material ejecting heads that are used in the production of color filters such as liquid crystal displays, electrode material ejecting heads that are used in electrode formation such as organic EL (Electro Luminescence) displays, FED (Field Emission Displays) and the like, organic material ejecting heads that are used in the production of biochips (biotips) and the like.

What is claimed is:

1. A liquid ejecting apparatus comprising:

a liquid ejecting head that has a pressure chamber, which is in communication with a nozzle, and a pressure generation unit that brings about a pressure fluctuation in a liquid inside the pressure chamber, and is capable of ejecting the liquid from the nozzle through actuation of the pressure generation unit; and a driving signal generation unit that causes a maintenance driving signal, which includes a maintenance pulse that causes the liquid to be ejected from the nozzle, to be generated during maintenance, wherein the maintenance pulse is a pulsed waveform that includes an expansion element that causes the pressure chamber to expand, a contraction element that causes a pressure chamber that is expanded by the expansion element to contract, and a reexpansion element that causes a pressure chamber that is contracted by the contraction element to expand again, and satisfies $$1.2\times Tc \leq T1 < 1.5\times Tc \quad (1)$$

when a time from a beginning of the contraction element to a beginning of the reexpansion element is given the term T1, and a specific vibration period that is caused in the liquid inside the pressure chamber is given the term Tc.

2. The liquid ejecting apparatus according to claim 1, wherein the maintenance pulse satisfies $$0.2\times Tc \leq T2 < 0.5\times Tc \quad (2)$$

when a time from a beginning of the reexpansion element to an end thereof is given the term T2.

3. The liquid ejecting apparatus according to claim 1, wherein the maintenance pulse satisfies $$0.1\times Vh \leq Vhm \leq 0.5\times Vh \quad (3)$$

when a change in voltage of the contraction element is given the term Vh, and a change in voltage of the reexpansion element is given the term Vhm.

4. The liquid ejecting apparatus according to claim 1, wherein a driving signal includes a microvibration pulse that brings about a pressure fluctuation in the liquid inside the pressure chamber to an extent at which liquid is not ejected from the nozzle, and wherein, the maintenance pulse is applied to the pressure generation unit after the microvibration pulse is applied to the pressure generation unit.

* * * * *